US005160026A

United States Patent [19]

Marsh

[11] Patent Number: 5,160,026

[45] Date of Patent: Nov. 3, 1992

[54] ADJUSTABLE LENGTH TOOL BOX FOR AUTOMOBILE REPAIR INCLUDING A PIVOTAL LEG

[76] Inventor: Daniel F. Marsh, 1240 Morey Cir., Hollister, Calif. 95023

[21] Appl. No.: 760,107

[22] Filed: Sep. 16, 1991

[51] Int. Cl.[5] ..... B65D 85/54

[52] U.S. Cl. ..... 206/373; 220/8; 229/10; 229/19; 312/902

[58] Field of Search ..... 206/372, 373, 335; 220/8; 229/9, 19, 10; 312/DIG. 33

[56] References Cited

U.S. PATENT DOCUMENTS

| | | | |
|---|---|---|---|
| 2,805,778 | 9/1957 | Yordi | 108/44 |
| 2,901,303 | 8/1959 | Anderson | 108/44 |
| 2,942,920 | 6/1960 | French . | |
| 2,958,566 | 11/1960 | Buck | 108/44 |
| 3,684,084 | 8/1972 | Kanzelberger | 229/19 X |
| 3,698,330 | 10/1972 | Krombach | 108/44 |
| 4,079,873 | 3/1978 | De La Mora | 220/8 X |
| 4,119,044 | 10/1978 | Hines | 312/DIG. 33 |
| 4,284,204 | 8/1981 | Carey Jr. | 220/8 X |
| 4,319,683 | 3/1982 | Correa | 206/349 |
| 4,418,626 | 12/1983 | Semien | 108/8 |
| 4,493,393 | 1/1985 | Serber | 108/44 |
| 4,911,083 | 3/1990 | Considine | 108/44 |
| 5,031,769 | 7/1991 | Shea et al. | 206/373 X |

*Primary Examiner*—Bryon P. Gehman

*Attorney, Agent, or Firm*—Julian Caplan

[57] ABSTRACT

A toolbox has a tray having compartments accessible from one side slidably received in a casing. The casing has one side closed and the opposite side formed with one or more openings. When the casing is slipped over the tray so that its closed side covers the tray compartments, the box may be carried or stored without tools, etc., falling out of the tray. When the casing is reversed, access to the tray compartments is obtained through openings in the casing. The tray may be slid out of the casing sufficiently so that with the engine hood raised, the rear end of the box rests on the cowling or other rear portion of the engine compartment and the forward end rests on the front end of the vehicle. To accommodate such positioning, a leg may be pivotally attached to the bottom of the forward end of the tray.

10 Claims, 2 Drawing Sheets

ADJUSTABLE LENGTH TOOL BOX FOR AUTOMOBILE REPAIR INCLUDING A PIVOTAL LEG

BACKGROUND OF THE INVENTION

1. Field of the Invention

This invention relates to a new and improved adjustable length tool box for automobile repair and similar uses. The box is intended to be used by supporting its rear end on the cowling of a vehicle and its forward end by means of the front end of the vehicle so that the box is supported over the engine, making tools therein conveniently accessible to the mechanic.

2. Description of Related Art

Compartmented tool boxes are well known in the art. However, the present invention provides a casing which fits over the tray of the box in a telescopic manner so that the overall length of the box may be adjusted to form a bridge between the cowling at the rear of the engine compartment and an appropriate ledge or other surface forward of the compartment. Thereby the tray may be supported over the engine so that tools in the box are conveniently accessible to the mechanic.

SUMMARY OF THE INVENTION

A compartmented tray to hold tools fits slidably within a casing. Thus the distance which the tray projects beyond the casing may be adjusted so that one end of the box fits on some support on the vehicle and the opposite end is supported by another support to locate the box in a convenient position. For example, if the mechanic is working on the engine of an automobile, the box may be positioned above the engine with its rear end supported by the cowling at the rear of the engine compartment and its forward end supported by a ledge or other portion of the front end of the vehicle. Preferably the box has a leg pivoted to the underside of the tray which may be swung forward and latched in a position to rest on the aforesaid ledge at the front of the vehicle.

Preferably the casing has one side closed and the opposite side formed with openings. For transportation, the closed side is positioned to cover the open compartments of the tray. In use, if the closed side is uppermost, it serves as a table on which tools and equipment may be placed. When the casing is inverted, the openings in the casing provide access to the tray compartments. Thus the mechanic has a choice of using the tool box with the closed side of the casing or the open side uppermost. A latch to keep the tray closed within the casing during transport and a carrying handle are provided.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENT

Figure 1:
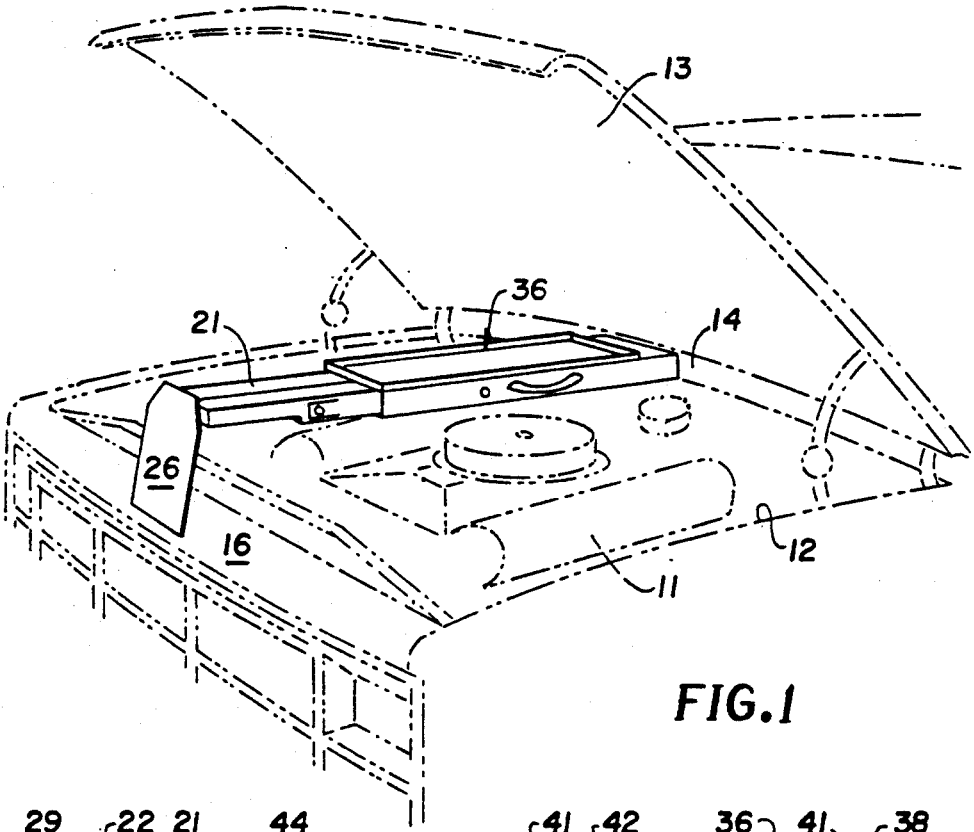
FIG. 1 is a schematic perspective view showing the tool box of the present invention in position in the engine compartment of a vehicle.
Figure 2:
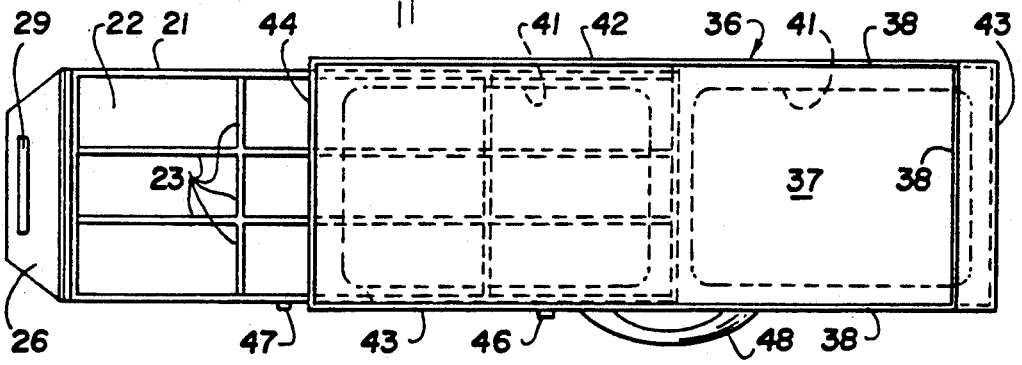
FIG. 2 is a plan view showing the closed side of the casing uppermost and the tray partially extended therefrom.

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

A typical use for the tool box of the present invention is positioned over the engine 11 in the engine compartment 12 of a vehicle with the hood 13 in open position. The rearward end of the toolbox rests on the cowling 14 at the rear of the compartment 12 or other suitable supporting surface. The forward end of the toolbox rests on the ledge 16 at the front of the vehicle or some other convenient location. The box itself is supported so that it is substantially horizontal above the engine 11 and is therefore readily accessible to the mechanic.

Tray 21 is substantially rectangular, having an open top 22 and a closed bottom 24 and is divided into compartments by separators 23. The number and position of such separators is subject to wide variation.

Figure 3:
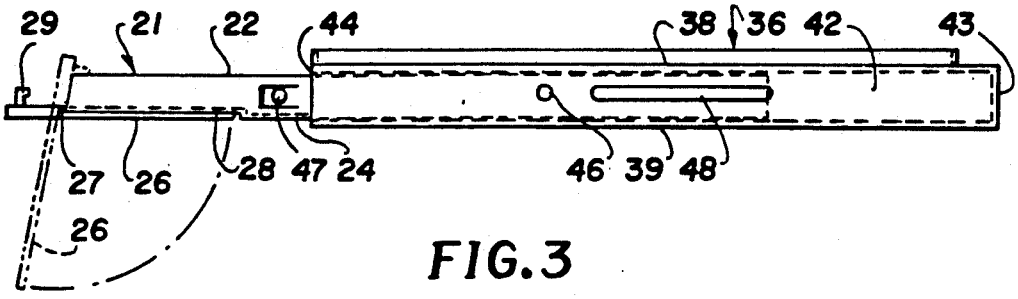
FIG. 3 is a side elevational view of the structure of FIG. 2.

To assist in positioning the tool box as shown in FIG. 1, a pivoted leg 26 is provided, the leg being pivoted about pivot 27 and when in closed position (as shown in solid lines in FIG. 3), the leg 26 is parallel to bottom 24 and fits into a recess 28 formed in bottom 24. In the position shown in FIG. 3 the leg 26 extends out forwardly of the forward edge of tray 21 and is formed with a latch 29. In the dot-and-dash position of FIG. 3 the leg 26 has been pivoted to the position shown in FIG. 1 and the latch 29 engages the forward edge of the tray 21. It will be noted that the tray 26 slants downwardly forwardly to support the tool box so that it is restrained from slipping forward and off of the cowling 14.

Figure 4:
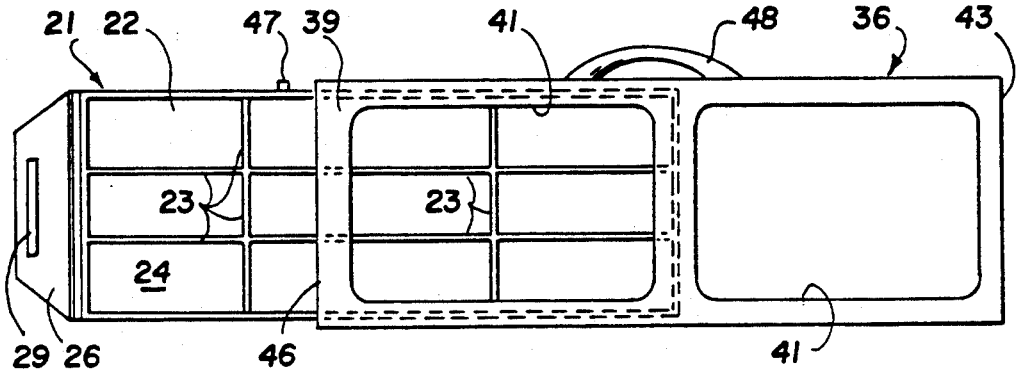
FIG. 4 is a view similar to FIG. 2 showing the open side of the casing in position over the tray.

Casing 36 is also rectangular and dimensioned so that the tray 21 slides therein. Casing 36 has a closed side 37 which may serve as a table when horizontal and uppermost. Side 37 may be provided with raised rims 38 to prevent objects from falling off the table. Opposite closed side 37 is an open side 39 formed with openings 41. In the position shown in FIG. 4, the mechanic may reach through openings 41 to obtain access to tools within the compartments in tray 21 which would otherwise be inaccessible. The side edges 42 are of a dimension such as to accommodate the height of the tray 21 so that the tray 21 may slide relative to the casing 36. The rearward end 43 is preferably closed and the forward end 44 is opened so that the tray 21 may extend therefrom.

To hold the tray in closed position within the casing 36, catch elements 46,47 may be formed on the casing 36 and tray 21 of any convenient nature. A handle 48 may be placed on one of the side edges 42 for convenience in carrying.

Figure 5:
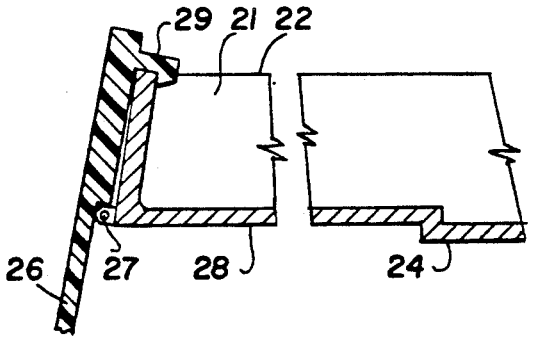
FIG. 5 is an enlarged fragmentary sectional view showing a portion of the tray and the leg in position of use.
Figure 6:
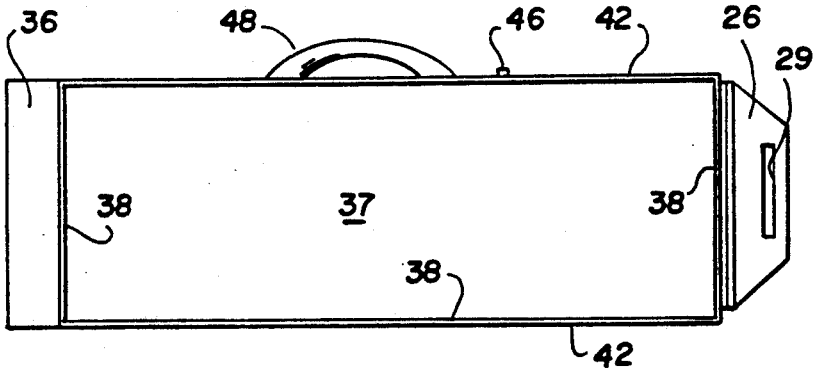
FIG. 6 is a side elevational view of the tool box in closed position for transportation or storage.

Directing attention to FIG. 6, the tray 21 is retracted within the casing 36, being held retracted by catch elements 46,47. To open the tray, the catch 46 is depressed and the latch 29 may be used to pull the tray 21 partially or totally out of the casing 36. The mechanic has a choice whether to position the closed side 37 uppermost and thereby provide a table on which tools and supplies are supported, or turn the casing to the position shown in FIG. 4 where the openings 41 provide ready access to the tools within the compartments 23. The tray 21 is extended sufficiently so that the rear end 43 of the tool box rests on the cowling 14 or other support. The leg 26 may, if desired, be swung from the solid line position of FIG. 3 to the dot-and-dash position (also shown in FIG. 5) and the latch 29 engaged on the forward end of the tray 21 so that the leg 26 slants downwardly forwardly. The use of leg 26 is optional, depending upon the construction of the vehicle and the availability of alternate means of supporting the tool box in a convenient and approximately horizontal location.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A tool box comprising an elongated tray having parallel longitudinal sides, a first end, a second end and a tray bottom, and a casing longitudinally slidable over said tray, said casing having an elongated top slightly larger than the width of said tray an elongated casing bottom substantially the same dimensions as said top, and casing side edges slightly wider than the depth of said tray interconnecting the longitudinal edges of said top and said casing bottom, the extent of extension of said tray from said casing being adjustable so that said tool box may rest on spaced supports, a leg, and means for mounting said leg on said tray bottom adjacent said first end for movement of said leg between a support position providing support for said first end and a retracted position.

2. A tool box according to claim 1 in which said casing is reversible relative to said tray whereby either said top or said casing bottom may be disposed above the top of said tray.

3. A tool box according to claim 1 in which one of said top and said casing bottom is formed with at least one opening to provide access through each at least one opening to said tray.

4. A tool box according to claim 1 in which on of said tip and said casing bottom has rims around an area thereof to prevent tools and parts from falling off said tool box when said tool box is supported substantially horizontal.

5. A tool box according to claim 1 which further comprises cooperating latch means on said tray and one of said side edges of said casing to latch said tray in a position substantially entirely within said casing.

6. A tool box according to claim 1 in which said leg is permanently secured to said tray bottom.

7. A tool box comprising an elongated tray having parallel longitudinal sides and an elongated casing longitudinally slidable over said tray, said casing having an elongated top slightly larger than the width of said tray, an elongated bottom substantially the same dimensions as said top, and side edges slightly wider than the depth of said tray interconnecting the longitudinal edges of said top and said bottom, the extent of extension of said tray from said casing being adjustable so that said tool box may rest on spaced supports, said tray having a tray bottom and a tray end, and a leg pivotally attached to said tray adjacent said tray bottom at said tray end, said leg being movable between a closed position parallel to said tray bottom and an open position extending downwardly relative to said tray bottom to provide a support for an end of said tool box adjacent said leg.

8. A tool box according to claim 7 further comprises cooperating latch means on said leg and said tray end to latch said leg in open position.

9. A tool box according to claim 7 in which said leg has a forward portion which extends beyond said tray when said tray is in closed position and which further comprises first latch means on said forward portion and cooperating second latch means on said tray to latch said leg in open position.

10. A tool box according to claim 9 in which said tray bottom is formed with a recess on its underside at said tray end to receive said leg when in closed position.

* * * * *